US009038769B2

(12) United States Patent
Tsujino

(10) Patent No.: US 9,038,769 B2
(45) Date of Patent: May 26, 2015

(54) SOUND ABSORBING BODY AND ELECTRONIC DEVICE

(71) Applicant: SEIKO EPSON CORPORATION, Tokyo (JP)

(72) Inventor: Kiyoshi Tsujino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/177,426

(22) Filed: Feb. 11, 2014

(65) Prior Publication Data

US 2014/0224573 A1 Aug. 14, 2014

(30) Foreign Application Priority Data

Feb. 14, 2013 (JP) ..... 2013-026333

(51) Int. Cl.

| | |
|---|---|
| ***B41J 29/10*** | (2006.01) |
| ***E04B 1/84*** | (2006.01) |
| ***G10K 11/162*** | (2006.01) |
| ***G10K 11/168*** | (2006.01) |
| *B41J 29/00* | (2006.01) |
| *E04B 1/74* | (2006.01) |

(52) U.S. Cl.

CPC ..... *G10K 11/162* (2013.01); *G10K 11/168* (2013.01)

(58) Field of Classification Search

USPC ..... 181/202, 201, 200, 290, 286, 294

See application file for complete search history.

(56) References Cited

U.S. PATENT DOCUMENTS

| | | | | |
|---|---|---|---|---|
| 3,652,360 | A * | 3/1972 | Hartman et al. | 156/244.11 |
| 3,895,143 | A * | 7/1975 | Tarlow | 428/40.9 |
| 4,213,516 | A * | 7/1980 | Sulewsky | 181/286 |
| 4,214,646 | A * | 7/1980 | Planes et al. | 181/287 |
| 4,428,454 | A * | 1/1984 | Capaul et al. | 181/290 |
| 4,590,114 | A * | 5/1986 | Holtman | 428/171 |
| 4,828,932 | A * | 5/1989 | Morimoto et al. | 428/608 |
| 5,149,920 | A * | 9/1992 | Meeker et al. | 181/290 |
| 5,304,415 | A * | 4/1994 | Kurihara et al. | 428/328 |
| 5,684,278 | A * | 11/1997 | Yasukawa et al. | 181/286 |
| 5,834,711 | A * | 11/1998 | Haines | 181/290 |
| 5,965,851 | A * | 10/1999 | Herreman et al. | 181/200 |
| 6,789,646 | B2 * | 9/2004 | Wang et al. | 181/293 |
| 7,033,497 | B1 * | 4/2006 | Yamaguchi et al. | 210/315 |
| 7,070,848 | B2 * | 7/2006 | Campbell | 428/137 |
| 7,080,712 | B2 * | 7/2006 | Tsuiki et al. | 181/204 |
| 7,605,097 | B2 * | 10/2009 | Thompson et al. | 442/408 |
| 7,712,580 | B2 * | 5/2010 | Fuller et al. | 181/294 |
| 7,857,923 | B2 * | 12/2010 | Suda et al. | 156/62.2 |
| 8,051,950 | B2 * | 11/2011 | Alston | 181/294 |
| 8,118,177 | B2 * | 2/2012 | Drapela et al. | 210/504 |
| 8,256,572 | B2 * | 9/2012 | Castagnetti et al. | 181/290 |
| 8,496,088 | B2 * | 7/2013 | Kitchen et al. | 181/290 |
| 2004/0050619 | A1 * | 3/2004 | Bargo, II | 181/290 |
| 2011/0067348 | A1 * | 3/2011 | Giles et al. | 52/741.1 |
| 2011/0226547 | A1 * | 9/2011 | Kuhl et al. | 181/294 |
| 2014/0124291 | A1 * | 5/2014 | Dugan et al. | 181/290 |
| 2014/0224571 | A1 * | 8/2014 | Tsujino | 181/201 |
| 2014/0224572 | A1 * | 8/2014 | Tsujino | 181/201 |
| 2014/0224573 | A1 * | 8/2014 | Tsujino | 181/202 |

FOREIGN PATENT DOCUMENTS

| | | | |
|---|---|---|---|
| JP | 05-254214 | A | 10/1993 |

* cited by examiner

*Primary Examiner* — Edgardo San Martin

(74) *Attorney, Agent, or Firm* — Global IP Counselors, LLP

(57) ABSTRACT

A sound absorbing body includes parts of different densities including a plurality of non-dense parts of lower density and a plurality of dense parts of higher density. The non-dense parts and the dense parts are alternately laminated obliquely.

7 Claims, 2 Drawing Sheets

SOUND ABSORBING BODY AND ELECTRONIC DEVICE

CROSS-REFERENCE TO RELATED APPLICATIONS

This application claims priority to Japanese Patent Application No. 2013-026333 filed on Feb. 14, 2013. The entire disclosure of Japanese Patent Application No. 2013-026333 is hereby incorporated herein by reference.

BACKGROUND

1. Technical Field

The present invention relates to a sound absorbing body and an electronic device.

2. Related Art

In the past, for example, with printers, items have been known for which a sound absorbing member for absorbing noise emanating from a printing head, platen and the like is equipped inside a case member (see Japanese Unexamined Patent Publication No. H05-254214, for example).

SUMMARY

However, since the density of the sound absorbing member noted above is almost uniform, it was necessary to make the thickness of the sound absorbing member even thicker to further increase the sound absorbing effect. Then, there was demand for a design that considered the thickness of the sound absorbing member when arranging the sound absorbing member inside an electronic device, and when the sound absorbing material became thicker, there was the problem that the external dimensions of electronic devices such as a printer and the like became larger.

The present invention was created to address at least a part of the problems described above, and can be realized as the modes or aspects below.

A sound absorbing body according to one aspect includes parts of different densities including a plurality of non-dense parts of lower density and a plurality of dense parts of higher density. The non-dense parts and the dense parts are alternately laminated obliquely.

With this constitution, when sound enters the sound absorbing body, while the sound is reflected by the dense part, the sound is propagated by the non-dense parts formed between the dense parts, so it is possible to attenuate the sound. Furthermore, the dense parts and non-dense parts are laminated obliquely, so the path for the sound to be propagated while being reflected is formed to be longer. By doing this, even if the thickness of the sound absorbing body is the same, the sound entry path inside the sound absorbing body is set to be longer, so it is possible to increase the sound absorbing effect without making the thickness of the sound absorbing body thicker. Also, the sound absorbing body is constituted as one unit. Specifically, it is formed as an integral unit. Because of this, for example, compared to an item for which the dense parts and the non-dense parts are formed separately and alternately laminated, management of adhesion of the lamination boundary and the like is unnecessary, so it is possible to perform handling easily.

With the sound absorbing body of the aspect noted above, a thickness in a lamination direction of the non-dense parts is preferably thicker than a thickness in the lamination direction of the dense parts.

With this constitution, the layer corresponding to the non-dense part becomes thicker (broader), so the sound reflection at the surface part of the sound absorbing body is decreased. By doing this, it is possible to increase the sound absorbing effect. Furthermore, when the layer corresponding to the non-dense part becomes thicker (broader), the sound propagation path becomes larger. Therefore, it is possible to attenuate the sound with even better efficiency.

With the sound absorbing body of the aspect noted above, the dense parts and the non-dense parts preferably include cellulose fibers, and the density of the dense parts and the non-dense parts is preferably a density of the cellulose fibers..

With this constitution, by the sound that enters the sound absorbing body making the cellulose fibers vibrates, it is possible to increase the sound absorbing effect.

With the sound absorbing body of the aspect noted above, the dense parts and the non-dense parts preferably include molten resin, and the density of the dense parts and the non-dense parts is preferably a density of the molten resin.

With this constitution, by changing the volume of the molten fiber, it is possible to form the non-dense parts and the dense parts easily.

With the sound absorbing body of the aspect noted above, the dense parts and the non-dense parts preferably include flame retardant, and the density of the dense parts and the non-dense parts is preferably a density of the flame retardant.

With this constitution, by changing the volume of the flame retardant, it is possible to form the non-dense parts and the dense parts easily.

With the sound absorbing body of the aspect noted above, the dense parts and the non-dense parts preferably include molten resin, and the non-dense parts and the dense parts are preferably bonded by the molten resin.

An electronic device according to another aspect is equipped with the sound absorbing body noted above.

With this constitution, it is possible to provide an electronic device with an excellent sound absorption effect. In this case, the sound absorbing body has high sound absorption efficiency, so it is possible to inhibit the thickness of the sound absorbing body. By doing this, it is also possible to make the electronic device more compact. Here, for example, the electronic device means items including various types of electronic device that emit sound such as printers and the like.

BRIEF DESCRIPTION OF THE DRAWINGS

Referring now to the attached drawings which form a part of this original disclosure.

DETAILED DESCRIPTION OF EXEMPLARY EMBODIMENTS

Embodiments

Figure 1:
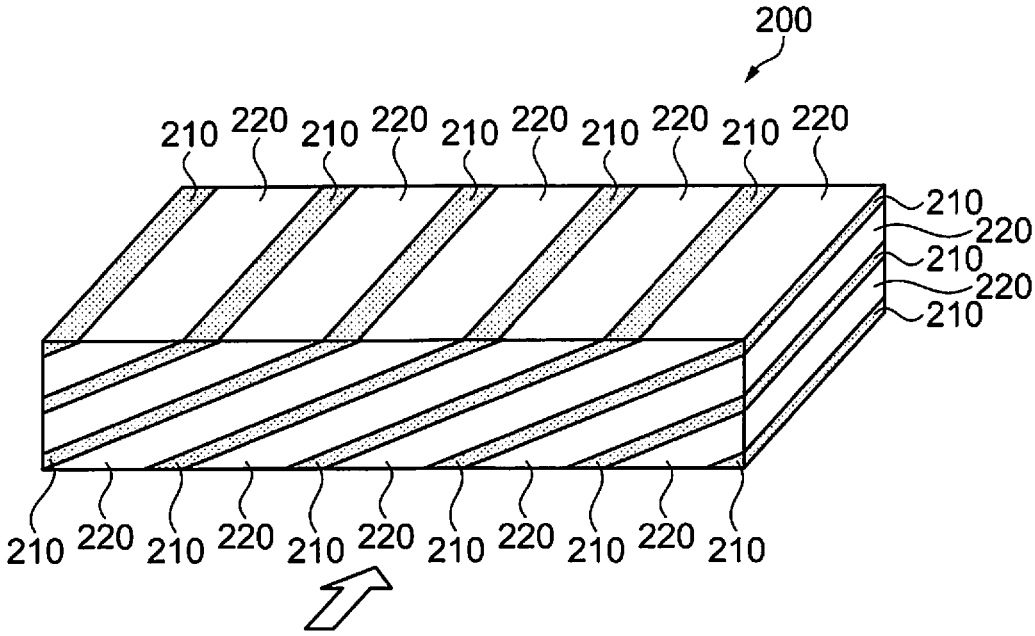
FIG. 1 is a pattern diagram showing the constitution of a sound absorbing body.

Following, we will describe embodiments of the present invention while referring to the drawings. In each drawing hereafter, to make each component and the like be a size of a level that is recognizable, the scale of each component and the like is shown different from actuality.

First, we will describe the constitution of the sound absorbing body. FIG. 1 is a pattern diagram showing the constitution of the sound absorbing body. The sound absorbing body 200 is an item that absorbs noise (does sound absorption) for electronic devices and the like, for example. As shown in FIG. 1, with the lateral cross section view (arrow direction in the drawing) of the rectangular solid shaped sound absorbing body 200, one sound absorbing body 200 has low density non-dense parts 220 and dense parts 210 of a higher density than the non-dense parts 220, and the non-dense parts (layers) 220 and the dense parts (layers) 210 are alternately laminated obliquely. This diagonal lamination extends in the direction orthogonal to the surface at which the diagonal lamination can be seen. Also, the diagonal of the diagonal lamination means diagonal in relation to the surface orthogonal to the surface at which the diagonal lamination can be seen. By obliquely laminating a plurality of the non-dense parts 220 and the dense parts 210 on one surface in this way, it is possible to make the non-dense parts 220 and the dense parts 210 alternately appear repeatedly on each surface of the sound absorbing body 200 orthogonal to one surface. At the surface orthogonal to one surface, rather than diagonal lamination in relation to each surface orthogonal to this surface, it becomes a parallel or orthogonal layer. In other words, the sound absorbing body 200 has two surfaces laminated in parallel to the one surface obliquely laminated for three mutually orthogonal surfaces. Even when sound enters from either surface of these two surfaces, it is possible to obtain a sound absorbing effect. Of these two surfaces, it is preferable to have sound enter from the surface that has a broader surface area.

The width dimension and the lamination count and the like of the non-dense parts 220 and the dense parts 210 can be set as appropriate. With this embodiment, lamination is done such that the thickness of the lamination direction of the non-dense parts 220 is thicker than the thickness of the lamination direction of the dense parts 210. By using this kind of constitution, the thickness of the layer corresponding to the non-dense parts 220 becomes thicker, so at the surface of the sound absorbing body 200, the non-dense parts 220 emerge broader than the dense parts 210, so reflection of sound on the surface of the sound absorbing body 200 is reduced, and it is possible to increase the sound absorbing effect. Also, the entry path for sound reflected by the dense part 210 becomes longer, and it is possible to further increase the sound absorbing properties.

It is also possible to laminate a plurality of sound absorbing bodies 200. By doing this, it is possible to further increase the sound absorbing effect.

The sound absorbing body 200 is an item formed from a mixture including cellulose fiber, molten resin, and flame retardant, and the density of the non-dense parts 220 and the dense parts 210 is the density of the cellulose fiber, the molten resin, or the flame retardant.

The cellulose fiber is an item for which a pulp sheet and the like is fibrillated into fiber form using a dry type defibrating machine such as a rotary crushing device, for example. The molten resin is an item that binds between cellulose fibers, maintains suitable strength (hardness and the like) for the sound absorbing body 200, prevents paper powder and fiber from scattering, and contributes to maintaining the shape of the sound absorbing body 200. For the molten resin, it is possible to use various modes such as fiber form, powder form and the like. Then, by heating the mixture with cellulose fiber and molten resin mixed, it is possible to melt the molten resin, and to fuse the cellulose fibers and harden them. It is preferable to fuse at a temperature of a level that will not cause thermal degradation of the cellulose fibers and the like. Also, it is preferable that the molten resin be in a fiber form that easily entwines with paper fibers in the fibrillated material. Furthermore, it is preferable to use a core-sheath structure conjugated fiber. With the core-sheath structure molten resin, the surrounding sheath part melts at a low temperature, and by the fiber form core part bonding with the molten resin itself or with the cellulose fiber, it is possible to make a strong bond.

The flame retardant is an item added to give flame resistance to the sound absorbing body 200. As the flame retardant, for example, it is possible to use inorganic materials such as aluminum hydroxide, magnesium hydroxide and the like, or phosphorous based organic materials (e.g. aromatic phosphate such as triphenylphosphate and the like).

As the sound absorbing body 200 forming method, for example, a mixture for which cellulose fiber, molten resin, and flame retardant are mixed are placed in a sieve, and this is deposited on a mesh belt arranged beneath the sieve to form a deposit. At this time, the mesh belt is moved at a designated speed, and the mixture is deposited so as to form a non-dense density part 220 and a denser part 210 for which the density is high. Then, the formed deposited substance undergoes pressurization heat treatment. By doing this, the molten resin is melted, and this is formed to a desired thickness. Furthermore, by die cutting to a desired dimension, the sound absorbing body 200 is formed.

The sound absorbing body 200 formed in this way has formed non-dense density parts 220, and dense parts 210 of a higher density than that of the non-dense density parts 220. Because of that, sound is reflected by the dense parts 210, and by the reflected sound being propagated by the non-dense parts 220, the sound is attenuated, undergoing sound absorption.

Figure 2:
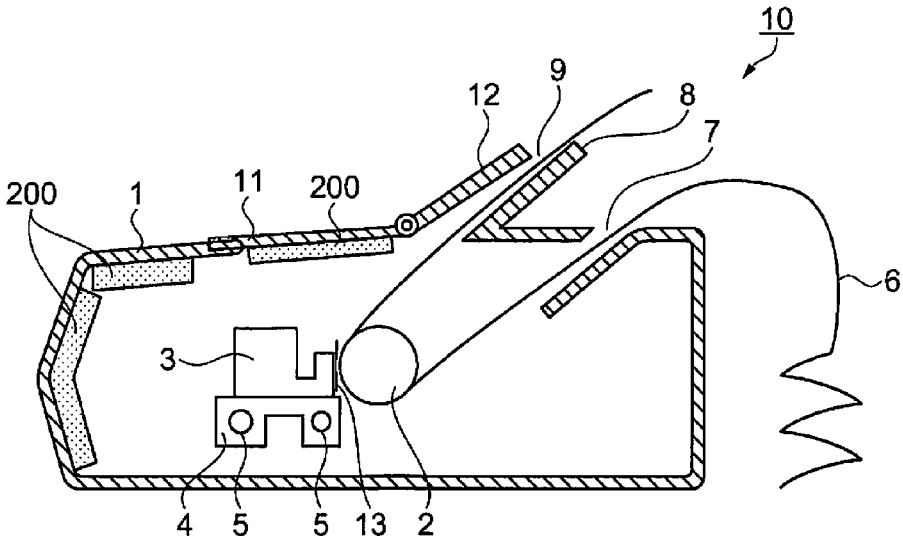
FIG. 2 is a cross section diagram showing the constitution of the printer.

Next, we will describe the constitution of the electronic device. With this embodiment, we will describe the constitution of a printer as the electronic device. FIG. 2 is a cross section diagram showing the constitution of the printer. As shown in FIG. 2, the printer 10 of this embodiment performs printing by giving an impact using a printing wire (not illustrated) provided inside the printing head 3 via an ink ribbon 13 on printing paper 6 as a printing medium arranged between a platen 2 and the printing head 3.

The printing paper 6 is fed from the paper feeding port 7 provided in the case member 1 of the printer 10 and wound on the platen 2, printing is performed by the printing head 3 (in addition to numbers, letters and the like, this is a broad concept also including printing graphs using dots and the like), and the paper is ejected from a paper ejection port 9. A carriage 4 can be guided by a guide shaft 5 and moved in the axial direction. The ink ribbon 13 is interposed between the printing head 3 and the printing paper 6, and the printing head 3 fixed to the carriage 4 performs printing by driving a plurality of printing wires provided inside the printing head 3 at a desired timing while moving in the axial direction.

A freely openable/closable cover 11 and a paper ejection port cover 12 are attached to a case member 1, and the paper ejection port cover 12 is rotatably connected to the cover 11. Also, the paper ejection port cover 12 is constituted with a transparent, light member, so the printing paper 6 is easy to see, and it is easy to take it out. Then, the printed printing paper 6 is ejected from the paper ejection port 9 along a paper guide 8.

Also, the printer 10 is equipped with the sound absorbing body 200 that absorbs noise (does sound absorption). The constitution of the sound absorbing body 200 is the same as the constitution in FIG. 1, so we will omit a description. With this embodiment, the sound absorbing body 200 is arranged at the part corresponding to the periphery of the printing head 3 of the case member 1. In specific terms, it is arranged at the part corresponding to the side opposite to the drive part of the printing head 3 of the case member 1. Furthermore, the sound absorbing body 200 is also arranged on the cover 11 corresponding to above the printing head 3. By doing this, when noise occurs with driving of the printing head 3, the generated noise enters the sound absorbing body 200, and while the sound is being reflected by the dense parts 210, the reflected sound is propagated by the non-dense parts 220, so in that process, the sound is effectively absorbed, and it is possible to prevent the diffusion of noise inside the case member 1.

With this embodiment, we described an example of a printer as the electronic device, but the invention is not limited to this, and it is also possible to apply this to various types of electronic devices.

As described above, with this embodiment, the following effects can be obtained.

(1) When sound enters the sound absorbing body 200, sound is propagated by the non-dense part 220 formed between two dense parts 210 while the sound is being reflected by the dense part 210, so it is possible to attenuate the sound. Furthermore, the dense parts 210 and the non-dense parts 220 are laminated obliquely, so the path for propagating sound while it is reflected is formed to be longer. By doing this, even when the thickness of the sound absorbing body 200 is the same, it is possible to set the propagation path for the sound that enters the sound absorbing body 200 to be longer, so it is possible to increase the sound absorption effect without making the thickness of the sound absorbing body 200 thicker. Also, the sound absorbing body 200 is constituted as one unit. Specifically, it is formed as an integrated unit. Because of that, for example compared to an item for which the dense parts 210 and the non-dense parts 220 are formed separately and alternately laminated, management of the adhesion of the lamination boundaries and the like is unnecessary, and it is possible to perform handling easily.

(2) With the printer 10 equipped with the sound absorbing body 200 noted above, it is possible to efficiently reduce noise during driving of the printing head 3.

EXAMPLES

Next, we will describe specific examples of the present invention.

1. Mixture

(1) Cellulose Fiber

A pulp sheet cut into several cm using a cutting machine was fibrillated into floc using a turbo mill (made by Turbo Kogyo Co., Ltd.).

(2) Molten Resin

This is polyethylene having a core-sheath structure, with the sheath melted at 100° C. or greater, and the core being 1.7 dtex molten fiber consisting of polyester (Tetoron, made by Teijin, Ltd.).

(3) Flame Retardant

Aluminum Hydroxide B53 (made by Nippon Light Metal Co., Ltd.)

2. Formation of the Sound Absorbing Body

Example 1

Formation of the Sound Absorbing Body A

A mixture C1 for which 100 weight parts of cellulose fiber, 15 weight parts of molten fiber, and 10 weight parts of flame retardant were air mixed and a mixture C2 for which 100 weight parts of cellulose fiber, 25 weight parts of molten fiber, and 10 weight parts of flame retardant were air mixed were alternately deposited on a mesh belt. At this time, mixtures C1 and C2 were alternately continuously deposited while moving the mesh belt. It is also possible to deposit while suctioning with a suction device. With example 1, the mixture C1 and the mixture C2 were alternately deposited six times each. Then, the deposited deposit material underwent pressurization heat treatment at 200° C. After that, this was cut to ø 29 mm and 10 mm thick to form sound absorbing body A. With that sound absorbing body A, non-dense parts (0.15 g/cm$^3$) and dense parts (0.17 g/cm$^3$) according to the difference in the molten resin volume were repeatedly laminated and a diagonal laminated body was formed.

Example 2

Formation of the Sound Absorbing Body B

A mixture C1 for which 100 weight parts of cellulose fiber, 15 weight parts of molten fiber, and 10 weight parts of flame retardant were air mixed and a mixture C3 for which 100 weight parts of cellulose fiber, 15 weight parts of molten fiber, and 20 weight parts of flame retardant were air mixed were alternately deposited on a mesh belt. At this time, so that mixtures C1 and C3 were laminated obliquely, mixtures C1 and C3 were alternately continuously deposited while moving the mesh belt. It is also possible to deposit while suctioning with a suction device. With example 2, the mixture C1 and the mixture C3 were alternately deposited six times each. Then, the deposited deposit material underwent pressurization heat treatment at 200 ° C. After that, this was cut to ø 29 mm and 10 mm thick to form sound absorbing body B. With that sound absorbing body B, non-dense parts (0.15 g/cm$^3$) and dense parts (0.17 g/cm$^3$) according to the difference in the flame retardant volume were repeatedly laminated and a diagonal laminated body was formed. With this example 2, it is not necessary to include flame retardant uniformly in the thickness direction of the sound absorbing body B, so it was possible to reduce the volume of flame retardant used.

Example 3

Formation of the Sound Absorbing Body C

A mixture C1 for which 100 weight parts of cellulose fiber, 15 weight parts of molten fiber, and 10 weight parts of flame retardant were air mixed was deposited on a mesh belt. At this time, mixture C1 was deposited while moving the mesh belt. After that, the deposited mixture C1 deposit material underwent pressurization heat treatment at 200 ° C. Then, mixture C4 for which 150 weight parts of cellulose fiber, 15 weight parts of molten fiber, and 10 weight parts of flame retardant were air mixed was deposited on the pressurization heat treated mixture C1. At this time, mixture C4 was deposited while moving the mesh belt. After that, the deposited mixture C4 deposit material underwent pressurization heat treatment at 200 ° C. Thereafter, mixture C1 and mixture C4 were alternately deposited, and underwent pressurization heat treatment. With example 3, the mixture C1 and the mixture C4 were alternately deposited six times each. After that, this was cut to ø 29 mm and 10 mm thick to form sound absorbing body C. With that sound absorbing body C, non-dense parts (0.15 g/cm$^3$) and dense parts (0.17 g/cm$^3$) according to the difference in the cellulose fiber volume were repeatedly laminated and a diagonal laminated body was formed.

Example 4

Formation of the Sound Absorbing Body D

A mixture C1 for which 100 weight parts of cellulose fiber, 15 weight parts of molten fiber, and 10 weight parts of flame retardant were air mixed was deposited on a bottom surface having a diagonal shape. Next, a mixture C2 for which 100 weight parts of cellulose fiber, 25 weight parts of molten fiber, and 10 weight parts of flame retardant were air mixed was deposited on the deposited mixture C1. After that, the mixtures C1 and C2 were alternately deposited. The deposited deposit material underwent pressurization heat treatment at 200 ° C. After that, this was cut to ø 29 mm and 10 mm thick to form sound absorbing body D. With that sound absorbing body D, non-dense parts (0.15 g/cm$^3$) and dense parts (0.17 g/cm$^3$) according to the difference in the molten resin volume were repeatedly laminated and a diagonal laminated body was formed.

Comparison Example 1

Formation of the Sound Absorbing Body R

A mixture C1 for which 100 weight parts of cellulose fiber, 15 weight parts of molten fiber, and 10 weight parts of flame retardant were air mixed was deposited on a mesh belt. Next, a mixture C2 for which 100 weight parts of cellulose fiber, 25 weight parts of molten fiber, and 10 weight parts of flame retardant were air mixed was deposited on the deposited mixture C1. At this time, the mesh belt was not moved. After that, the mixtures C1 and C2 were alternately deposited. Then, the deposited deposit material underwent pressurization heat treatment at 200 ° C. After that, this was cut to ø 29 mm and 10 mm thick to form sound absorbing body R. With that sound absorbing body R, though non-dense parts (0.15 g/cm$^3$) and dense parts (0.17 g/cm$^3$) appeared according to the difference in the molten fiber volume, in contrast to the constitution of the sound absorbing bodies A, B, C, and D formed with example 1 through example 4, a laminated body was formed for which the non-dense parts and the dense parts were laminated in planar form. Specifically, the non-dense parts and the dense parts were not laminated obliquely.

3. Evaluation

Next, an evaluation of sound absorption properties was performed for example 1 through example 4 and comparison example 1 noted above. This sound absorbing property evaluation measures the sound absorption rate (normal incident sound absorption rate) based on JIS A 1405-2. Specific details are as noted below.

(a) Sound Absorption Property Evaluation Method

Figure 3:
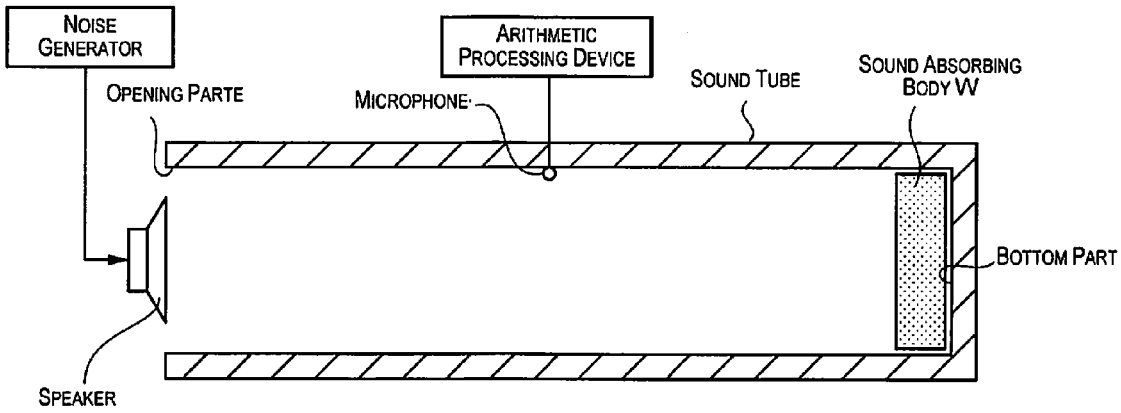
FIG. 3 is a pattern diagram showing the evaluation method of the sound absorbing properties.

FIG. 3 is a pattern diagram showing the method for evaluating the sound absorption properties. As shown in FIG. 3, the equipment for evaluating the sound absorbing properties includes a sound tube, a bottom part provided at one end part of the sound tube, an opening part opened at the other end part of the sound tube, a microphone arranged inside the sound tube, a speaker arranged in the opening part of the sound tube, a noise generator connected to the speaker, and an arithmetic processing device and the like.

After the sound absorbing body W is set in the bottom part of the sound tube, sound of a designated frequency is radiated from the speaker, and a sound field is generated inside the sound tube. Then, the normal incident sound absorption rate is calculated based on the sound pressure signal obtained from the microphone inside the sound tube. By this evaluation, it is possible to evaluate the sound absorbing properties of the sound absorbing body W. The sound absorbing body W of examples 1 through 4 is arranged such that the obliquely laminated surface faces the speaker, and the sound absorbing body W of the comparison example 1 is arranged such that the surface for which the non-dense part and the dense part are laminated in planar form faces the speaker.

(b) Radiated Sound Frequency (b-1) 1000 Hz
(b-2) 2000 Hz
(b-3) 4000 Hz

Sound absorption was evaluated for example 1 through example 4 and comparison example 1 noted above. The evaluation results are shown in table 1. With table 1, the sound absorption rate for each frequency of example 1 through example 4 is expressed when the sound absorption rate of the comparison example 1 is set as 1. Therefore, when the number is higher than the sound absorption rate 1 with the comparison example 1, the evaluation is that there is a greater sound absorption effect. Meanwhile, when the number is smaller than the absorption rate 1 with the comparison example 1, the evaluation is that there is a low sound absorption effect.

TABLE 1

| | 1000 Hz | 2000 Hz | 4000 Hz |
|---|---|---|---|
| Example 1 | 1.46 | 1.18 | 1.19 |
| Example 2 | 1.52 | 1.50 | 1.19 |
| Example 3 | 1.68 | 1.26 | 1.40 |
| Example 4 | 1.04 | 1.24 | 1.19 |
| Comparison Example 1 | 1 | 1 | 1 |

As shown in table 1, with example 1 through example 4, the sound absorption rate for all frequency areas corresponding to all the examples is a numerical value greater than the absorption rate with the comparison example 1, and the effect was of having excellent sound absorbing properties. This is because the dense parts and the non-dense parts are alternately laminated obliquely with the sound absorbing body A through the sound absorbing body D of example 1 through example 4, so the path for propagating reflected sound by the non-dense parts while the sound is reflected by the dense parts is formed to be long.

The diagonal lamination of the non-dense parts and the dense parts which is a feature point of this application can be understood by being seen with the eye by the external appearance in some cases, but cannot be understood by being viewed in some cases when there is only a slight difference between the non-density and the density. As a verification method in such a case, after a liquid such as water and the like is included, when the sound absorbing body is torn off, the layer direction can be understood. Also, when a liquid with color such as ink and the like is dripped, if there is a layer for which infiltration occurs easily obliquely, this can be called non-dense/dense diagonal lamination. When the overall sound absorbing body has uniform density, when ink is dropped, it infiltrates almost uniformly laterally while infiltrating downward by gravity. Also, when there is a horizontal non-dense/dense layer, there is a layer for which lateral infiltration occurs easily.

Following, we will describe modification examples.

With the embodiments noted above, to prevent fuzz on the surface of the sound absorbing body 200 and the like, it is possible to adhere a thin non-woven cloth to the surface. Since adhered non-woven cloth is thinner than the sound absorbing body 200, there is little effect on the sound absorbing properties.

With the embodiments noted above, the sound absorbing body 200 was a rectangular solid, but the invention is not limited to this. It is also possible to have a notch or recess in a portion of the rectangular solid, or to have a circular arc part or a sloped part rather than a rectangular solid.

With the embodiments noted above, lamination was done such that the thickness of the layer corresponding to the non-dense parts 220 was thicker than the thickness of the layer corresponding to the dense parts 210, but the invention is not limited to his constitution. For example, it is also possible to have the thickness of the layer corresponding to the non-dense parts 220 be the same thickness as the thickness of the layer corresponding to the dense parts 210. Even when set in this way, it is possible to increase the sound absorbing effect.

We noted the density for each embodiment and comparison example, but these are merely examples. Also, densities are numbers for the greatest locations and the least locations.

With the embodiments noted above, the pulp sheet includes wood pulp such as of conifer trees, broad leafed trees and the like, non-wood plant fibers such as of hemp, cotton, kenaf and the like, and used paper and the like.

With the embodiments noted above, cellulose fiber was the main constituent, but as long as it is a material that absorbs sound, and can be given density differences, this is not limited to cellulose fiber. It is also possible to use fiber with a raw material of a plastic such as polyurethane or polyethylene terephthalate (PET) and the like, or another fiber such as wool and the like.

The method for forming the sound absorbing body is not limited to the method noted with the embodiments noted above. As long as the features of this application can be presented, another manufacturing method such as a wet method and the like can also be used.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sound absorbing body comprising:

parts of different densities including a plurality of non-dense parts of lower density and a plurality of dense parts of higher density with the non-dense parts and the dense parts being alternately laminated obliquely, the non-dense parts having the same first volumetric mass density, the dense parts having the same second volumetric mass density greater than the same first volumetric mass density.

2. The sound absorbing body according to claim 1, wherein a thickness in a lamination direction of the non-dense parts is thicker than a thickness in the lamination direction of the dense parts.

3. The sound absorbing body according to claim 1, wherein the dense parts and the non-dense parts include cellulose fibers, and the density of the dense parts and the non-dense parts is a density of the cellulose fibers.

4. The sound absorbing body according to claim 1, wherein the dense parts and the non-dense parts include molten resin, and the density of the dense parts and the non-dense parts is a density of the molten resin.

5. The sound absorbing body according to claim 1, wherein the dense parts and the non-dense parts include flame retardant, and the density of the dense parts and the non-dense parts is a density of the flame retardant.

6. The sound absorbing body according to claim 1, wherein the dense parts and the non-dense parts include molten resin, and the non-dense parts and the dense parts are bonded by the molten resin.

7. An electronic device comprising the sound absorbing body according to claim 1.

* * * * *